US007513301B2

(12) United States Patent
Victor

(10) Patent No.: US 7,513,301 B2
(45) Date of Patent: Apr. 7, 2009

(54) LIQUID AERATION PLUNGER

(75) Inventor: Bruce M. Victor, Ft. Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 0 days.

(21) Appl. No.: 11/124,805

(22) Filed: May 9, 2005

(65) Prior Publication Data

US 2006/0249284 A1 Nov. 9, 2006

(51) Int. Cl.
*E21B 34/14* (2006.01)

(52) U.S. Cl. ..... 166/105

(58) Field of Classification Search ..... 166/105, 166/68.5, 372; 417/56–60
See application file for complete search history.

(56) References Cited

U.S. PATENT DOCUMENTS

| | | | | | |
|---|---|---|---|---|---|
| 1,993,266 | A | * | 3/1935 | Evans | 417/60 |
| 2,147,766 | A | | 2/1939 | Coberly | 103/46 |
| 2,714,855 | A | | 8/1955 | Brown | 103/52 |
| 2,931,304 | A | | 4/1960 | Massey | 103/4 |
| 2,970,547 | A | * | 2/1961 | McMurry | 417/57 |
| 3,181,470 | A | | 5/1965 | Clingman | |
| 3,861,471 | A | | 1/1975 | Douglas | 166/314 |
| 4,268,227 | A | | 5/1981 | Roeder | 417/358 |
| 4,275,790 | A | | 6/1981 | Abercrombie | |
| 4,502,843 | A | | 3/1985 | Martin | |
| 4,712,981 | A | | 12/1987 | Gramling William D. | 417/56 |
| 5,253,713 | A | | 10/1993 | Gregg et al. | |
| 5,333,684 | A | | 8/1994 | Walter et al. | |
| 5,374,163 | A | | 12/1994 | Jaikaran | 417/172 |
| 5,431,229 | A | | 7/1995 | Christensen | 166/369 |
| 5,868,554 | A | | 2/1999 | Giacomino et al. | |
| 5,915,475 | A | | 6/1999 | Wells et al. | 166/68.5 |
| 6,148,923 | A | | 11/2000 | Casey | 166/372 |
| 6,176,309 | B1 | * | 1/2001 | Bender | 166/68 |
| 6,209,637 | B1 | | 4/2001 | Wells | |
| 6,250,392 | B1 | | 6/2001 | Muth | |
| 6,273,690 | B1 | | 8/2001 | Fischer, Jr. et al. | 417/555.2 |
| 6,325,152 | B1 | | 12/2001 | Kelley et al. | 166/370 |
| 6,543,543 | B2 | | 4/2003 | Muth | 166/370 |
| 6,554,580 | B1 | | 4/2003 | Mayfield et al. | |

(Continued)

FOREIGN PATENT DOCUMENTS

CA 2 428 618 A1 11/2004

(Continued)

OTHER PUBLICATIONS

Bruce M. Victor, "Sand Plunger", U.S. Appl. No. 11/105,753, filed Apr. 14, 2005; complete specification, drawings, and filing receipt attached hereto.

(Continued)

*Primary Examiner*—John Kreck
(74) *Attorney, Agent, or Firm*—Aileen Law; A Law Firm, P.C.

(57) ABSTRACT

A plunger apparatus operates to propel one or more jets of gas through one or more internal orifices and/or nozzles out through an aperture and into a liquid load whereby a transfer of the gas into the liquid load causes turbulent aeration to the liquid load during a plunger rise. This action can boost the carrying capacity of a plunger lift system resulting in improved well production.

21 Claims, 10 Drawing Sheets

U.S. PATENT DOCUMENTS

| | | | | |
|---|---|---|---|---|
| 6,568,477 | B1 | 5/2003 | Dveyrin | |
| 6,591,737 | B2 | 7/2003 | Giacomino | |
| 6,637,510 | B2 | 10/2003 | Lee | 166/108 |
| 6,669,449 | B2 | 12/2003 | Giacomino | |
| 6,705,404 | B2 | 3/2004 | Bosley | 166/372 |
| 6,725,916 | B2 | 4/2004 | Gray et al. | |
| 6,746,213 | B2 | 6/2004 | Giacomino | |
| 6,907,926 | B2 | 6/2005 | Bosley | 166/108 |
| 6,945,762 | B2 | 9/2005 | Williams | 417/546 |
| 2002/0066572 | A1 | 6/2002 | Muth | 166/369 |
| 2002/0153141 | A1 | 10/2002 | Hartman et al. | 166/302 |
| 2002/0162662 | A1 | 11/2002 | Passamaneck et al. | 166/370 |
| 2003/0141051 | A1 | 7/2003 | Abbott et al. | 166/53 |
| 2003/0155129 | A1 | 8/2003 | Gray et al. | 166/370 |
| 2003/0215337 | A1 | 11/2003 | Lee | 417/56 |
| 2004/0129428 | A1 | 7/2004 | Kelley | 166/372 |
| 2006/0054329 | A1 * | 3/2006 | Chisholm | 166/372 |

FOREIGN PATENT DOCUMENTS

| | | |
|---|---|---|
| RU | 2225502 | 3/2004 |

OTHER PUBLICATIONS

Bruce M. Victor, "Variable Orifice Bypass Plunger", U.S. Appl. No. 11/110,447, Apr. 20, 2005; complete specification drawings, and filing receipt attached hereto.

Bruce M. Victor, Multi-part Plunger, U.S. Appl. No. 10/803,373, filed Mar. 18, 2004; complete specification, drawings, and filing receipt attached hereto.

Jeffrey L. Giacomino, U.S. Appl. No. 11/071,148, "Thermal Actuated Plunger" filed Mar. 3, 2005. (No copy attached per MPEP 609.04 (a)(II)(C) because Application is stored in Image File Wrapper System.).

Jeffrey L. Giacomino, U.S. Appl. No. 11/060,513, "Data Logger Plunger" filed Feb. 17, 2005. (No copy attached per MPEP 609.04 (a)(II)(C) because Application is stored in Image File Wrapper System.).

Bruce M. Victor, U.S. Appl. No. 11/010,168, "Internal Shock Absorber Bypass Plunger" filed Dec. 10, 2004. (No copy attached per MPEP 609.04 (a)(II)(C) because Application is stored is Image File Wrapper System.

* cited by examiner

LIQUID AERATION PLUNGER

FIELD OF THE INVENTION

The present invention relates to a plunger lift apparatus for the lifting of formation liquids in a hydrocarbon well. More specifically, the plunger comprises an internal nozzle apparatus that operates to propel one or more jets of gas through an internal aperture and into a liquid load, transferring gas into the liquid load and causing an aeration of the liquid load during lift.

BACKGROUND OF THE INVENTION

A plunger lift is an apparatus that is used to increase the productivity of oil and gas wells. Nearly all wells produce liquids. In the early stages of a well's life, liquid loading is usually not a problem. When rates are high, the well liquids are carried out of the well tubing by the high velocity gas. As a well declines, a critical velocity is reached below which the heavier liquids do not make it to the surface and start to fall back to the bottom, exerting back pressure on the formation and loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also helps keep the tubing free of paraffin, salt or scale build-up.

A plunger lift system works by cycling a well open and closed. During the open time, a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

A typical installation plunger lift system 100 can be seen in FIG. 1. Lubricator assembly 10 is one of the most important components of plunger system 100. Lubricator assembly 10 includes cap 1, integral top bumper spring 2, striking pad 3, and extracting rod 4. Extracting rod 4 can be employed depending on the plunger type. Within lubricator assembly 10 is plunger auto catching device 5 and plunger sensing device 6.

Sensing device 6 sends a signal to surface controller 15 upon plunger 200 arrival at the well top. Plunger 200 can be the plunger of the present invention or other prior art plungers. Sensing the plunger is used as a programming input to achieve the desired well production, flow times and wellhead operating pressures.

Master valve 7 should be sized correctly for the tubing 9 and plunger 200. An incorrectly sized master valve 7 will not allow plunger 200 to pass through. Master valve 7 should incorporate a full bore opening equal to the tubing 9 size. An oversized valve will allow gas to bypass the plunger causing it to stall in the valve.

If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system. The bumper spring typically protects the tubing from plunger impact in the absence of fluid. Fluid accumulating on top of plunger 200 may be carried to the well top by plunger 200.

Surface control equipment usually consists of motor valve (s) 14, sensors 6, pressure recorders 16, etc., and an electronic controller 15 which opens and closes the well at the surface. Well flow 'F' proceeds downstream when surface controller 15 opens well head flow valves. Controllers operate on time and/or pressure to open or close the surface valves based on operator-determined requirements for production. Additional features include: battery life extension through solar panel recharging, computer memory program retention in the event of battery failure and built-in lightning protection. For complex operating conditions, controllers can be purchased that have multiple valve capability to fully automate the production process.

FIGS. 2, 2A, 2B and 2C are side views of various plunger mandrel embodiments. Although an internal mandrel orifice 44 may or may not be present in prior art plungers, such an orifice can define a passageway for the internal nozzle of the present device. Each mandrel shown comprises a male end sleeve 41. Threaded male area 42 can be used to attach various top and bottom ends as described below in FIGS. 3, 3A, 3B and 3C.

A. As shown in FIG. 2B, plunger mandrel 20 is shown with solid ring 22 sidewall geometry. Solid sidewall rings 22 can be made of various materials such as steel, poly materials, Teflon®, stainless steel, etc. Inner cut grooves 30 allow sidewall debris to accumulate when a plunger is rising or falling.

B. As shown in FIG. 2C, plunger mandrel 80 is shown with shifting ring 81 sidewall geometry. Shifting rings 81 allow for continuous contact against the tubing to produce an effective seal with wiping action to ensure that most scale, salt or paraffin is removed from the tubing wall. Shifting rings 81 are individually separated at each upper surface and lower surface by air gap 82.

C. As shown in FIG. 2, plunger mandrel 60 has spring-loaded interlocking pads 61 in one or more sections. Interlocking pads 61 expand and contract to compensate for any irregularities in the tubing, thus creating a tight friction seal.

D. As shown in FIG. 2A, plunger mandrel 70 incorporates a spiral-wound, flexible nylon brush 71 surface to create a seal and allow the plunger to travel despite the presence of sand, coal fines, tubing irregularities, etc.

E. Flexible plungers (not shown) are flexible for coiled tubing and directional holes, and can be used in straight standard tubing as well.

FIGS. 3, 3A, 3B and 3C are side views of fully assembled plungers each comprising a fishing neck 'A'. Each plunger comprises a bottom striker 46 suited for hitting the well bottom.

Recent practices toward slim-hole wells that utilize coiled tubing also lend themselves to plunger systems. With the small tubing diameters, a relatively small amount of liquid may cause a well to load-up, or a relatively small amount of paraffin may plug the tubing.

Plungers use the volume of gas stored in the casing and the formation during the shut-in time to push the liquid load and plunger to the surface when the motor valve opens the well to the sales line or to the atmosphere. To operate a plunger installation, only the pressure and gas volume in the tubing/casing annulus is usually considered as the source of energy for bringing the liquid load and plunger to the surface.

The major forces acting on the cross-sectional area of the bottom of the plunger are:

The pressure of the gas in the casing pushes up on the liquid load and the plunger.

The sales line operating pressure and atmospheric pressure push down on the plunger.

The weight of the liquid and the plunger weight push down on the plunger.

Once the plunger begins moving to the surface, friction between the tubing and the liquid load acts to oppose the plunger.

In addition, friction between the gas and tubing acts to slow the expansion of the gas.

In some cases, a large liquid loading can cause the plunger lift to operate at a slowed rate. A well's productivity can be impacted by the lift rate. Thus a heavy liquid load can be a major factor on a well's productivity.

SUMMARY OF THE INVENTION

The present apparatus provides a plunger lift apparatus that can more effectively lift a heavy liquid. In short, a heavy liquid load can be brought to the surface at a higher rise velocity.

One or more internal orifices allow for a transfer of gas from the well bottom into the liquid load during plunger lift. This jetting of the gas causes an aeration to occur so the plunger may carry a heavy liquid load to the well top in an improved manner. In addition, a liquid load can rise at a higher velocity. The apparatus can increase the production of liquid allowing for a faster rise velocity with a fixed liquid load.

One aspect of the present invention is to provide a plunger apparatus that can have an extended capacity in carrying a liquid load to the well top.

Another aspect of the present invention is to increase lift velocity of the plunger and liquid load when rising to the well top.

Another aspect of the present invention is to provide a means for transferring momentum from gas at the well bottom through a gas jet and onto a liquid load to assist with overall plunger lift load.

Another aspect of the present invention is to provide a plunger that can be used with any existing plunger sidewall geometry.

Other aspects of this invention will appear from the following description and appended claims, reference being made to the accompanying drawings forming a part of this specification wherein like reference characters designate corresponding parts in the several views.

The present invention comprises a plunger lift apparatus having a top section with an inner longitudinal orifice and one or more nozzle exit apertures (orifices) at or near its upper surface. The top section can comprise a standard American Petroleum Institute (API) fishing neck, if desired, but other designs are possible. A mandrel mid section allowing for the various sidewall geometries comprises an internal orifice throughout its length. A lower section also comprises an internal longitudinal orifice. The sections can be assembled to form the liquid aeration plunger of the present invention. Gas passes through an internal plunger conduit (orifice), up through an internal nozzle, and out through one or more apertures thereby transferring momentum from a gas to a liquid load providing a lift assist and causing gaseous aeration of the liquid load.

When the surface valves open to start the lift process, down hole pressure will result in gas being forced through the plunger nozzles, exiting one or more apertures into the liquid load transferring momentum from the jetting gas onto the liquid load. The gas transfer causes aeration and results in a liquid lift assist. The plunger may carry a heavier liquid load to the well top because the aeration effectively lightens the load. The present apparatus can carry a fixed liquid load at an improved velocity as compared to a non-aerated liquid load. Applying a soapy mixture down to the well bottom between the well casing and tubing can assist the aeration process by allowing a higher surface tension in the gaseous bubbles formed within the liquid load.

An additional embodiment incorporates a nozzle type aerator in a bypass plunger design, employing the same basic concept of momentum transfer and gaseous aeration of the liquid load.

The present apparatus allows for improved productivity in wells that have large levels of loaded liquid. The disclosed plunger allows for a more efficient lift of high liquid loads both increasing the lift capacity and also the lift velocity by aerating the liquid load during plunger lift. The liquid aeration plunger is easy to manufacture, and easily incorporates into the design into existing plunger geometries.

Figure 1:
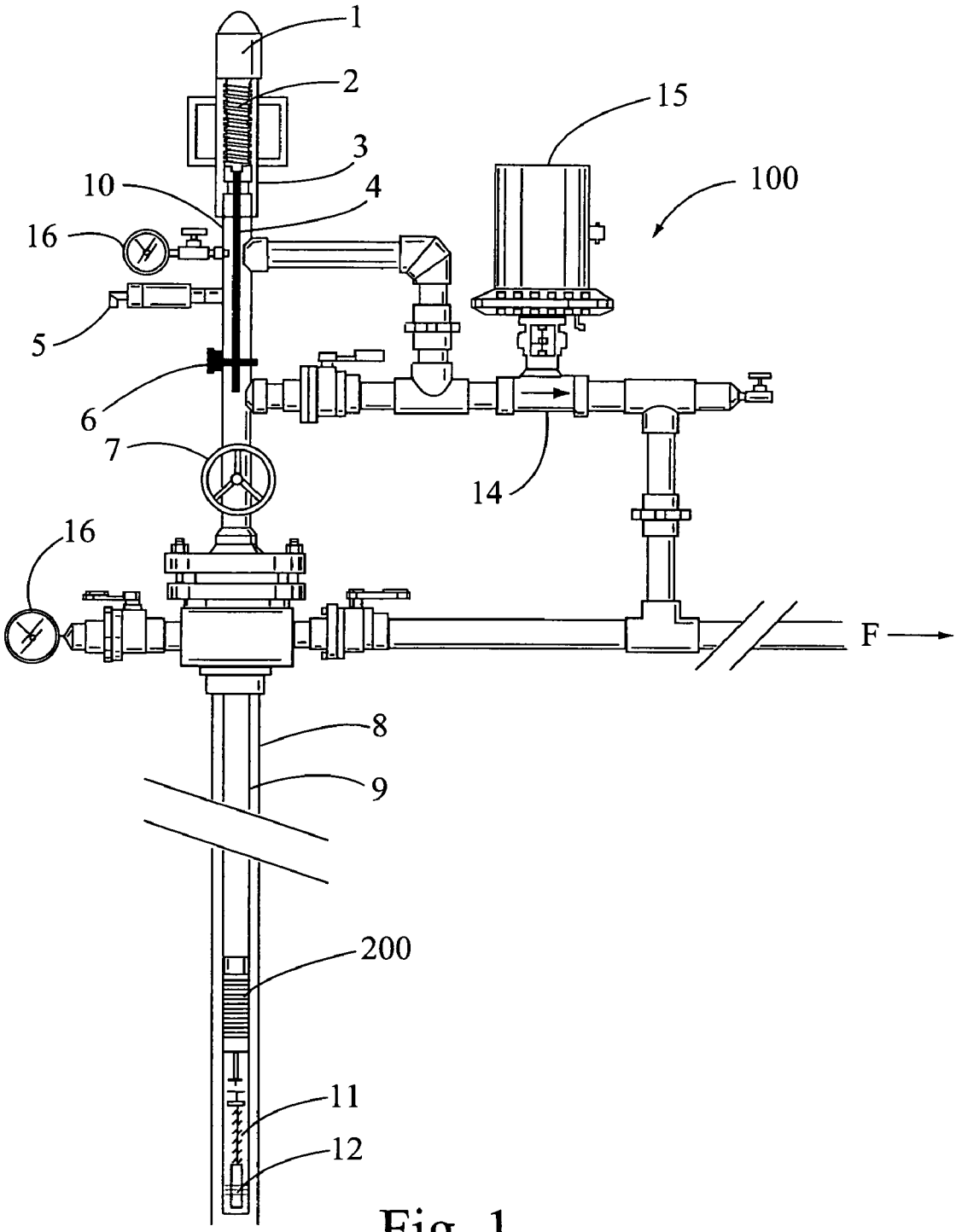
Fig. 1 (PRIOR ART)
FIG. 1 (prior art) is an overview depiction of a typical plunger lift system installation.
Figure 2:
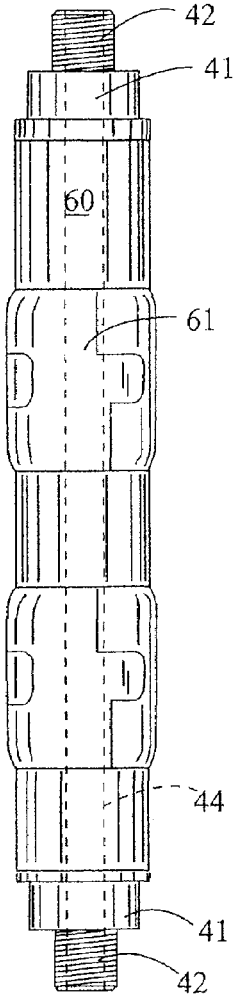
Fig. 2 (PRIOR ART)
FIGS. 2, 2A, 2B and 2C (prior art) are side views of plunger mandrels with various plunger sidewall geometries.
Figure 2A:
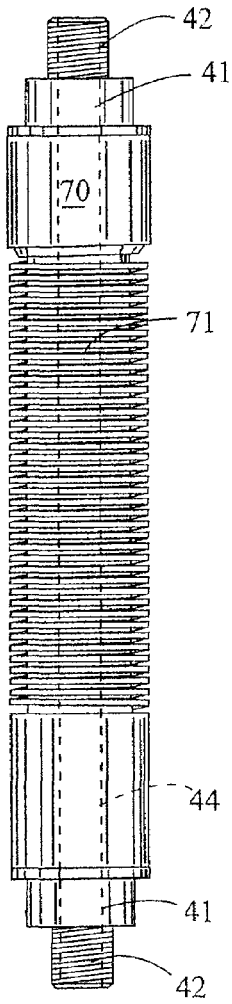
Fig. 2A (PRIOR ART)
Figure 2B:
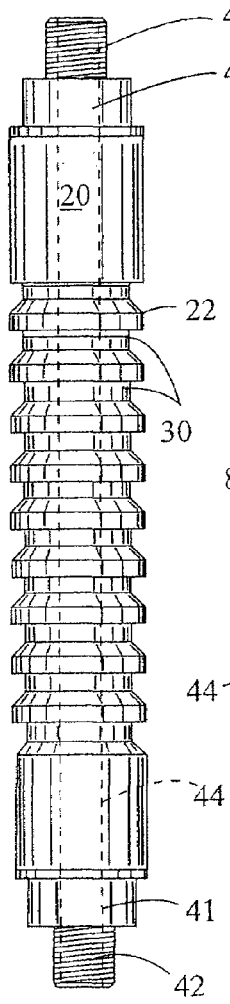
Fig. 2B (PRIOR ART)
Figure 2C:
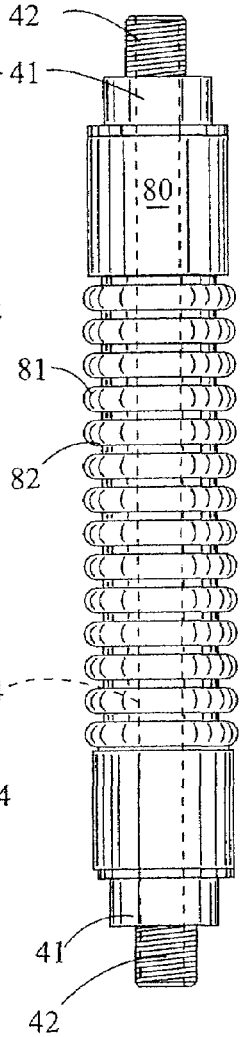
Fig. 2C (PRIOR ART)
Figures 3, 3A, 3B, 3C:
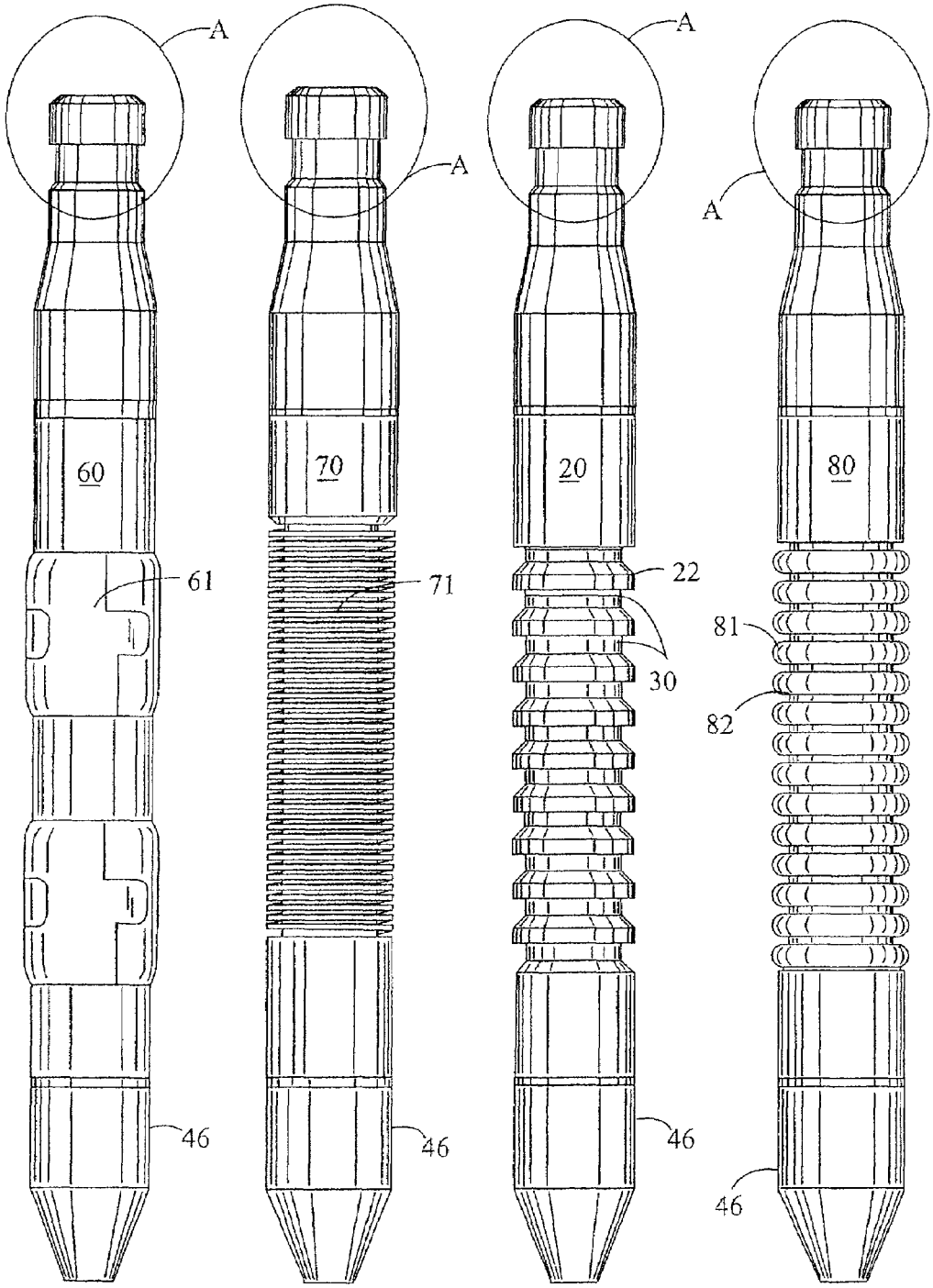
Fig. 3 (PRIOR ART)
Fig. 3A (PRIOR ART)
Fig. 3B (PRIOR ART)
Fig. 3C (PRIOR ART)
FIGS. 3, 3A, 3B and 3C (prior art) are side views of fully assembled plungers each shown with a fishing neck top and utilizing various plunger sidewall geometries.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE INVENTION

Referring now to the drawings, the present invention is a liquid aeration plunger 2000 apparatus (FIG. 5) having an upper section 200 (FIGS. 4,5) with an inner longitudinal orifice and one or more nozzle exit apertures at or near its upper end. The top section can comprise a standard American Petroleum Institute (API) fishing neck, if desired, but other designs are possible. The plunger has a mandrel mid section that can accommodate various sidewall geometries, an internal orifice throughout its length and a lower section 46A (FIG. 5) with an internal longitudinal orifice.

All the sections can be connected together to allow the gaseous aeration of the liquid load by the plunger of the present invention. When the surface valves open to start the lift process, gas is forced through the plunger nozzles. As the gas exits from the apertures into the liquid load, transferring momentum from the gas to the liquid, a turbulent and gaseous aeration of the liquid occurs. This action results in a more efficient lift of the liquid to the well top.

Figure 4:
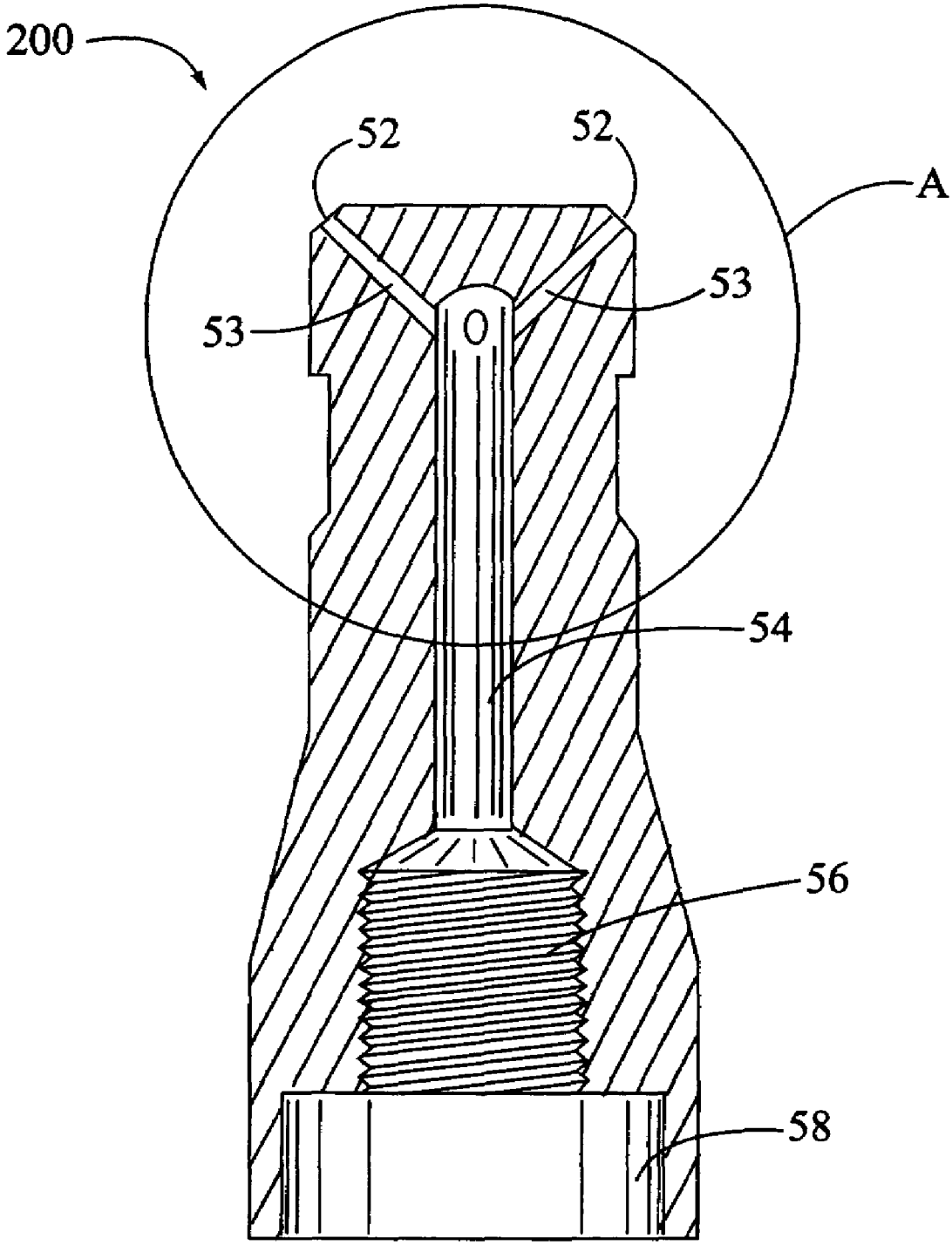
FIG. 4 is a cross-sectional view of an upper section embodiment of a liquid aeration plunger showing an internal orifice, nozzles, and nozzle exit apertures.
Figure 5:
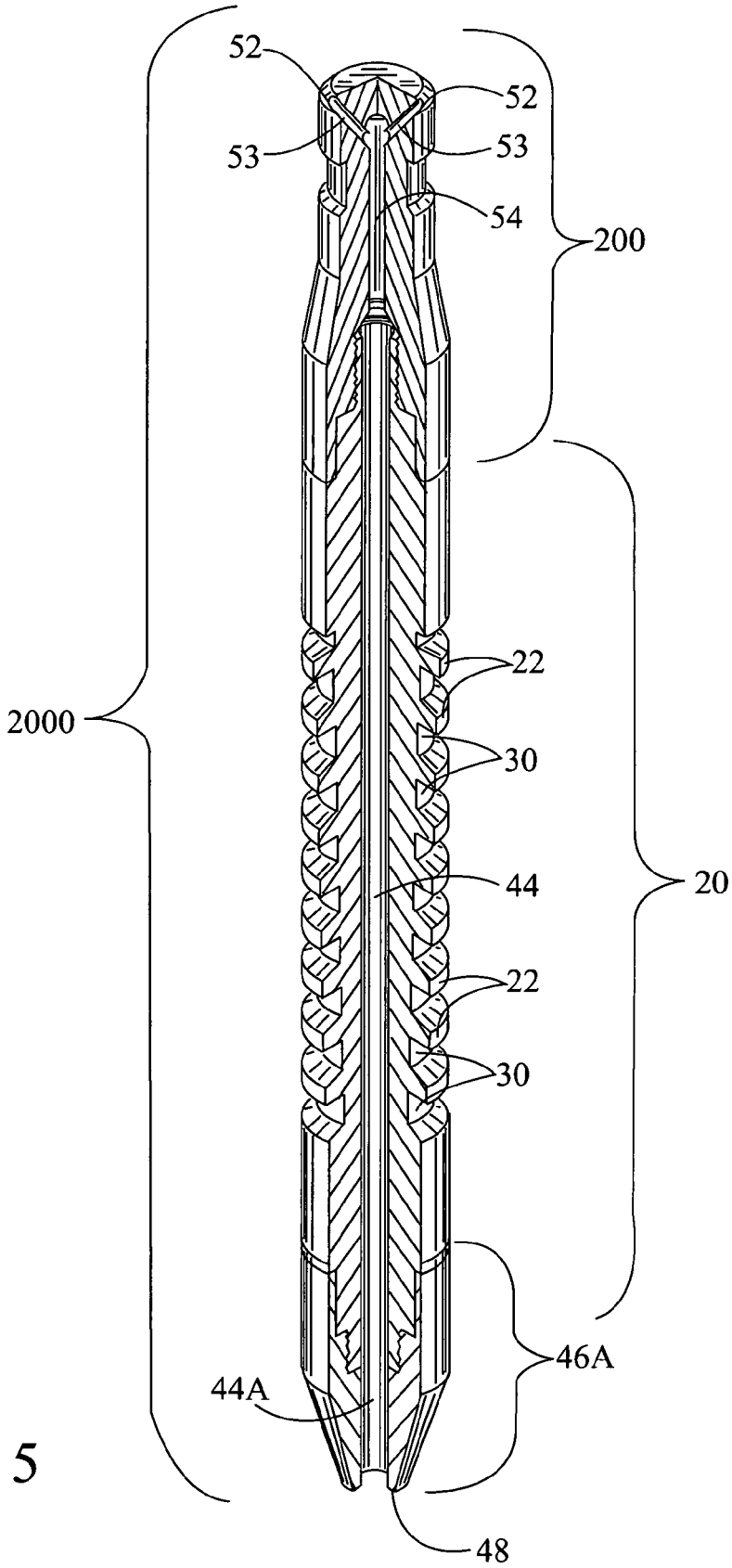
FIG. 5 is an isometric cut away view of a liquid aeration plunger embodiment.

FIG. 4 is a cross-sectional view of upper section 200 of the liquid aeration plunger shown in FIG. 5. The upper external end is a prior art fishing neck 'A' design. Upper section 200 is shown with four nozzle exit apertures 52 dispersed evenly around its upper surface, with each exiting at about 45° to the liquid load boundary. Upper section 200 can easily connect to any mandrel such as that shown in FIGS. 2, 2A, 2B and 2C. Internal female sleeve orifice 58 mates with the male end sleeve 41 and threaded internal female sleeve orifice 56 mates with threaded male area 42. Upper section internal through-orifice 54 can communicate with each nozzle exit orifice 53. It should be noted that the nozzle quantity, location, size and designs are offered by way of example and not limitation. For example, four nozzle orifices 53 and four aperture exits 52 are shown, each at about a 45° cut angle into upper section orifice 54. However, the present invention is not limited to the design shown. Other nozzle designs could easily be incorporated to encompass one or more exit nozzle apertures, various size nozzle holes, various angles, etc.

The upper end has at least one exit orifice that has a total cross sectional area in the range of about 0.25% to 10% of the maximum plunger cross sectional area. Typically, the smallest range of the cross sectional area of either the lower end apertures or the upper end apertures or the internal longitudinal orifice is about 3.22 $mm^2$ (about 0.005 inch 2) to about 32.3 $mm^2$ (about 0.05 $inch^2$). In FIG. 4, the four nozzle orifices are each typically about 2.36 mm (about 0.093 inch) in diameter, combining to about 17.4 $mm^2$ (about 0.027 $inch^2$) of area as compared to the outside diameter of a typical plunger of about 47 mm (about 1.85 inch) or about 1735 $mm^2$ (about 2.69 $inch^2$).

FIG. 5 is an isometric cut side view of liquid aeration plunger 2000. In this embodiment, upper section 200, solid wall plunger mandrel 20, and lower section 46A, are shown having interconnected internal orifices. Lower section 46A is modified from present art by providing lower section internal orifice 44A. Lower section 46A can be attached to a mandrel by mating male end sleeves 41 and threaded male areas 42, previously shown in FIGS. 2, 2A, 2B and 2C.

Liquid aeration plunger 2000 functions to allow gas to pass into lower section 46A at lower entry aperture 48, up through lower section internal orifice 44A, through internal mandrel orifice 44, then up through upper section internal through-orifice 54, through nozzle exit orifices 53 and finally exiting out of apertures 52. It should also be noted that the size of nozzle exit orifices 53 and apertures 52 control the amount of gas jetting. The depicted embodiment design is shown by way of example and not limitation. It should be noted that although the mandrel shown is solid wall plunger mandrel 20, any other sidewall geometry can be utilized including all aforementioned sidewall geometries. Lower section internal orifice 44A, internal mandrel orifice 44, and upper section internal through-orifice 54 can be manufactured in various internal dimensions.

Figure 6:
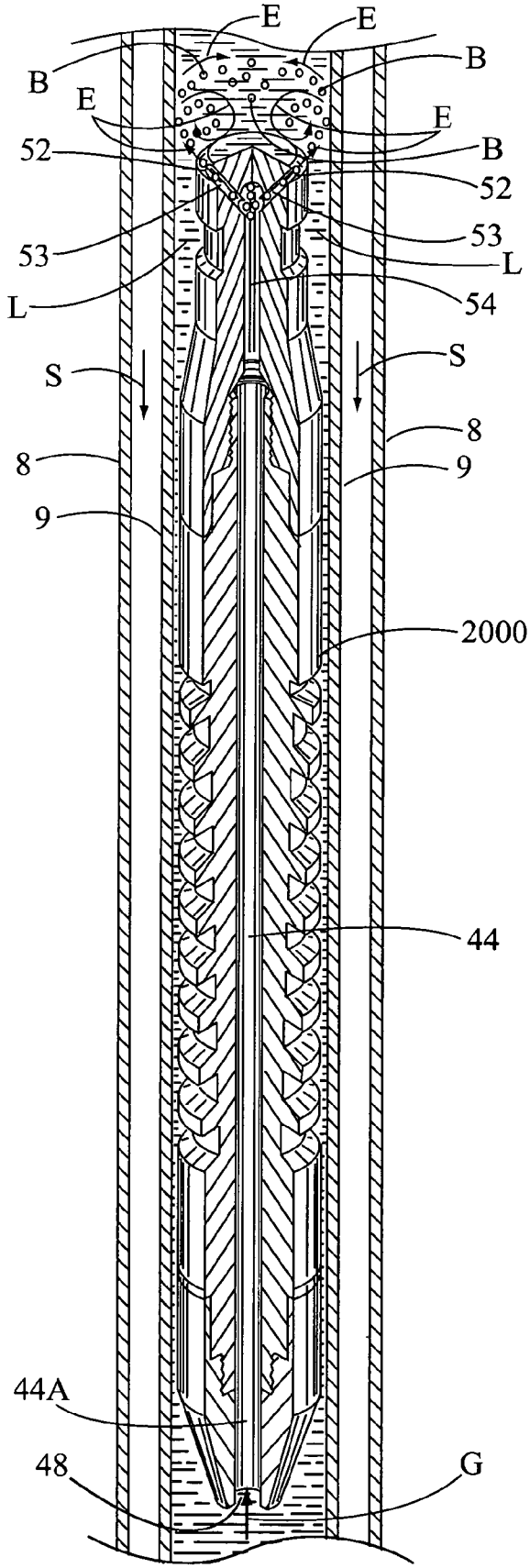
FIG. 6 is an isometric cut away view of a liquid aeration plunger embodiment during a plunger lift.
Figures 7, 7A, 7B, 7C:
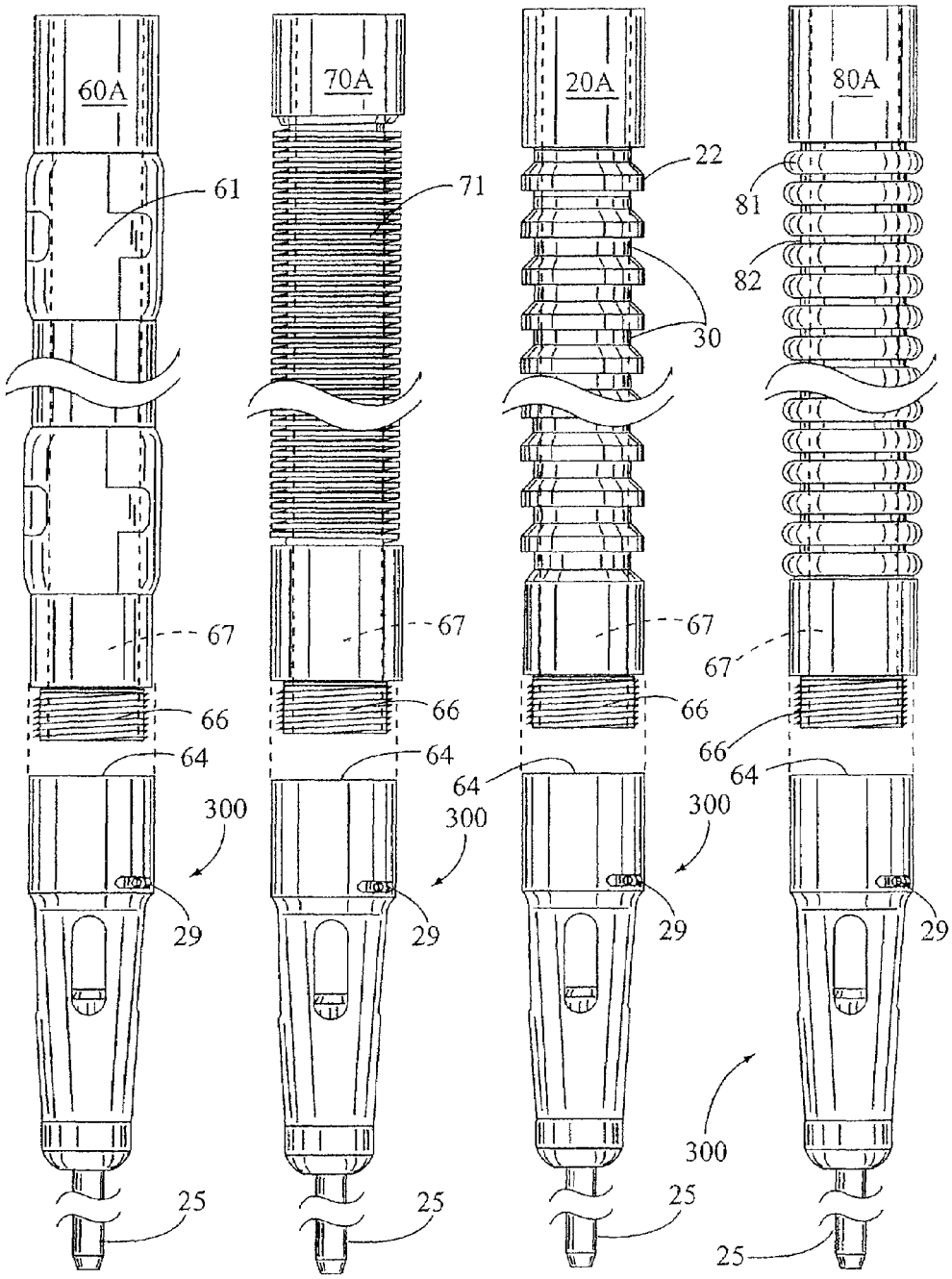
Fig. 7 (PRIOR ART)
Fig. 7A (PRIOR ART)
Fig. 7B (PRIOR ART)
Fig. 7C (PRIOR ART)
FIGS. 7, 7A, 7B and 7C (prior art) show side views of variable orifice bypass valves and plunger mandrels with various sidewall geometries.

FIG. 6 shows liquid aeration plunger 2000 during a plunger lift. When the surface valves open to start the lift process, gas G enters the plunger lower entry aperture 48, passes up through all internal orifices (44A, 44, 54, 53), exits apertures 52 in directions E, and jets into the liquid load L to form bubbles B in a turbulent fashion. This action results in a transfer of momentum from the jetting gas into the liquid load. The gaseous jetting, turbulence and aeration of the liquid is a result of the momentum transfer. The plunger may carry a heavier than average liquid load to the well top, thereby increasing the load capacity and/or allowing for a faster rise velocity of a given liquid load. The result is an increase in well productivity for wells with high liquid loads.

Injecting a soapy mixture S down to the well bottom between the aforementioned well casing 8 and tubing 9 can assist the aeration process by allowing a higher surface tension in the gaseous bubbles B formed within the liquid load L. Liquid aeration plunger 2000 can easily be manufactured with any existing plunger sidewall geometry.

Another embodiment of the present invention incorporates a nozzle type aerator in a bypass plunger design, employing the same basic concept of momentum transfer and gaseous aeration of the liquid load. Bypass plungers typically have an actuator that is in a 'open' position during plunger descent to the well bottom and is in a 'closed' position during a plunger rise to the well top. Modifications to the actuator rod, to the bypass valve, or mandrel housing at the closed interface can be made to accommodate an orifice or an aperture for gas jetting. In an embodiment modifying a typical bypass valve, one or more small apertures or orifices within the actuator rod provide for gas jetting into the liquid load during the 'closed' position of the actuator rod. Thus when in a 'closed' position, the bypass plunger will function via the transfer of momentum and gas jetting causing aeration of the liquid load.

FIGS. 7, 7A, 7B and 7C show side views of variable orifice bypass valves (VOBV) 300. Pad plunger mandrel section 60A, brush plunger mandrel section 70A, solid ring plunger mandrel section 20A, and shifting ring plunger mandrel section 80A can each be mounted to a VOBV 300 by mating female threaded end 64 and male threaded end 66. Each plunger 61, 71, 21 and 81 is shown in an unassembled state. A standard American Petroleum Institute (API) internal fishing neck can also be used. Each mandrel section also has hollowed out core 67. Each depicted bottom section is a VOBV 300 shown in its full open (or full bypass) set position. The bypass function allows fluid to flow through during the return trip to the bumper spring with the bypass closing when the plunger reaches the well bottom. The bypass feature optimizes plunger travel time in high liquid wells. The present invention is not limited by the specific design of bypass valve and VOBV is shown only as an example.

Figure 8A:
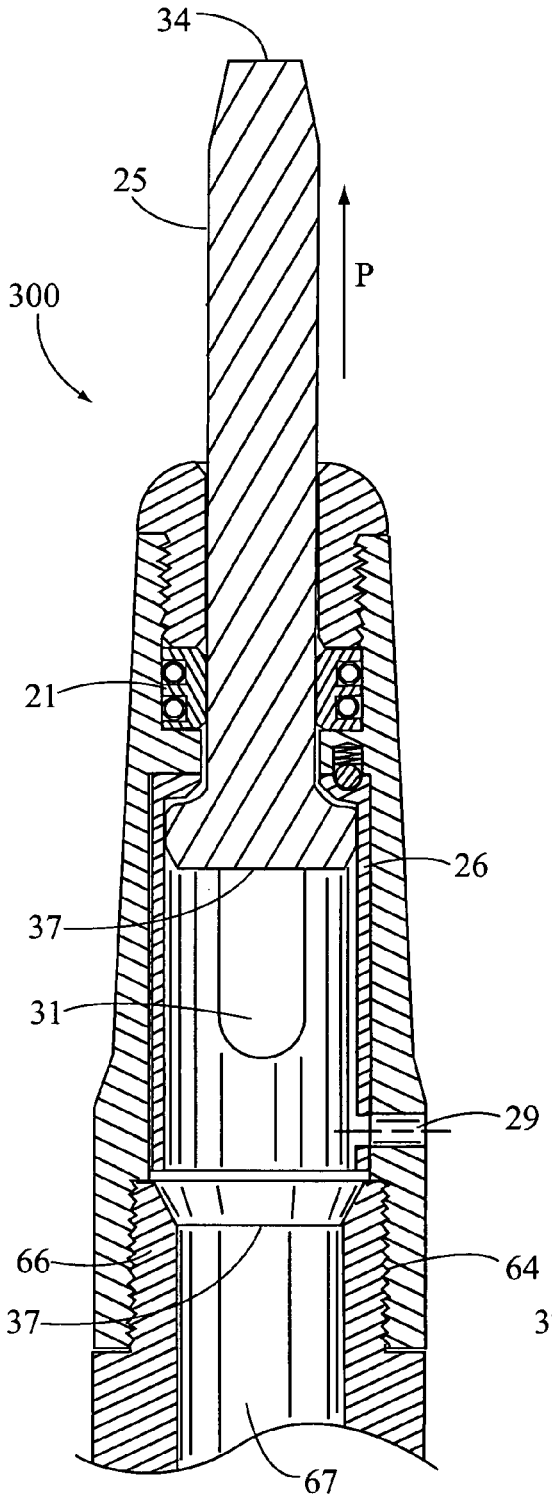
Fig. 8A (PRIOR ART)
FIG. 8A (prior art) is a side cross-sectional view of a variable orifice bypass valve assembly with the actuator rod shown in the open (or bypass) position.

FIG. 8A is a side cross-sectional view of a prior art VOBV assembly 300 with actuator rod 25 shown in the open (or bypass) position. VOBV assembly 300 threaded interface 64 joins to a mandrel section via mandrel threads 66 (See FIGS. 7, 7A, 7B and 7C). When VOBV assembly 300 arrives at the well top, the aforementioned striker rod within the lubricator hits actuator rod 25 at rod top end 37 moving actuator rod 25 in direction P to its open position. In its open position, the top end of actuator rod 25 rests against variable control cylinder 26 internal surface. Brake clutch 21 will hold actuator rod 25 in its open position allowing well loading (gas/fluids, etc.) to enter the open orifice and move up through the hollowed out section of bypass plunger during plunger descent. This feature optimizes its descent to the well bottom as a function of the bypass setting. Access hole 29 is for making adjustments to the bypass setting via variable orifice opening 31. In other words, the amount of gas allowed to enter the bypass valve can be adjusted.

Figure 8B:
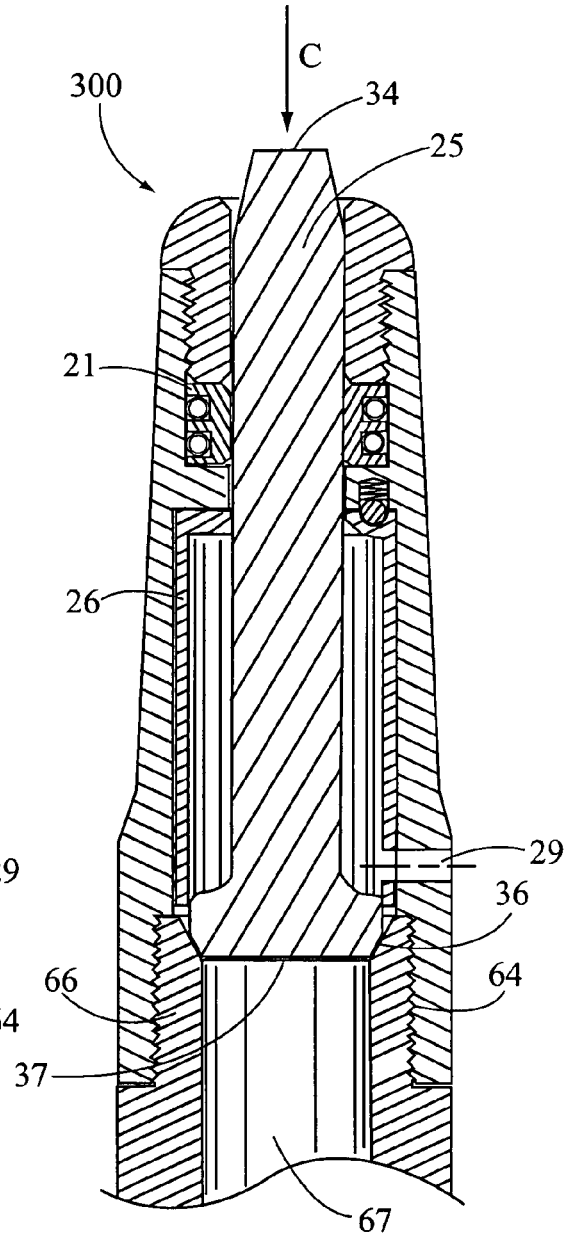
Fig. 8B (PRIOR ART)
FIG. 8B (prior art) is a side cross-sectional view of a variable orifice bypass valve assembly and similar to FIG. 8A but with the actuator rod shown in its closed (no bypass) position.

FIG. 8B is a side cross-sectional view of a prior art VOBV assembly 300 and similar to FIG. 8A but with actuator rod 25 depicted in its closed (no bypass) position. When bottom bumper spring striker end 34 hits the well bottom, the actuator rod 25 moves in direction C to a closed position. In the closed position, rod top end 37 with its slant surface 36 closes against threaded top section end 66 and is held in the closed position by brake clutch 21 thus allowing VOBV 300 to be set in a closed bypass condition to enable itself to rise back to the well top.

Figure 9:
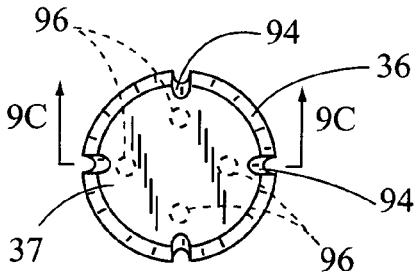
FIG. 9 is a top view of a grooved actuator rod.
Figure 9A:
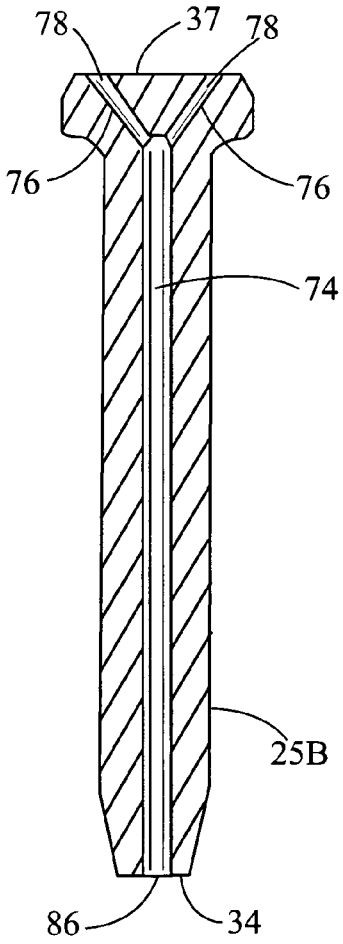
FIGS. 9A, 9B show cross sectional views of possible modifications of an actuator rod for a bypass valve assembly to allow for gas entry in a closed position.
Figure 9B:
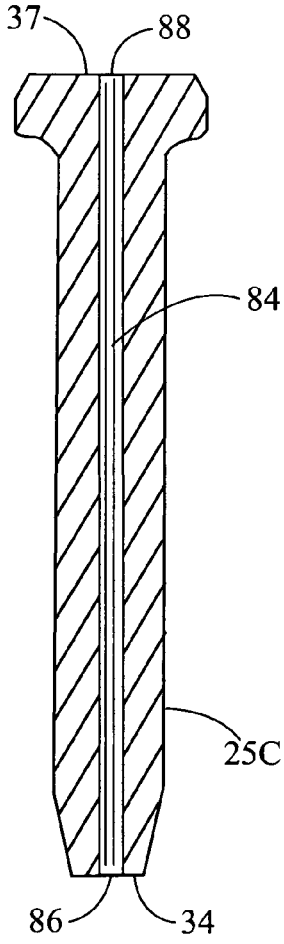

FIGS. 9A, 9B show possible modifications of actuator rod 25 which are described in more detail below. When actuator rod 25 is in a closed position, there is a seal along slant surface 36, which prevents gas flow through the VOBV. The modifications of the embodiment of the present invention will allow for small gas exit aperture(s) when modified actuator rods are in a closed position (FIG. 8B). Allowing a portion of gas to exit when in a closed position will cause the aforementioned momentum transfer from the gas into the liquid load within central hollowed out core 67 (see FIGS. 10, 10A, 10B) and will result in a liquid lift assist in a bypass plunger. The modifications are shown by way of example and not limitation of the present invention.

Figure 9C:
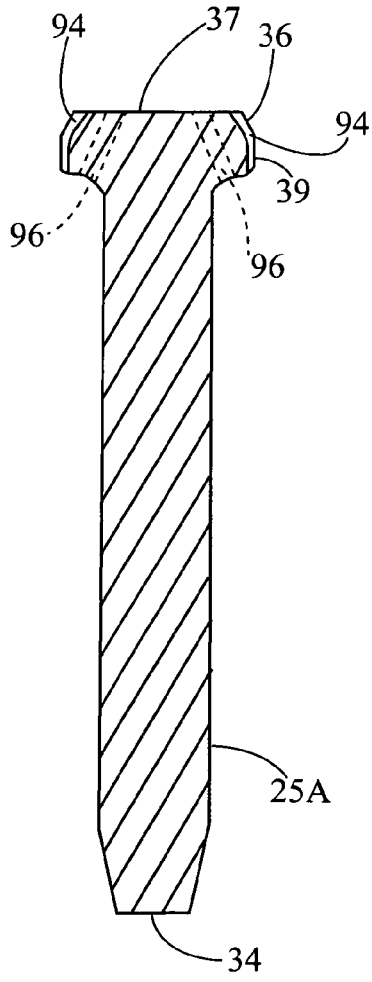
FIG. 9C is a cross sectional view of FIG. 9 along line 9C-9C.

FIGS. 9, 9C are views of grooved actuator rod 25A comprising four grooves 94 cut partially into actuator rod top surface 37, into slant surface 36 and down top side surface 39. The number and the type of grooves are shown by way of example and not limitation. For example, grooves also could be cut into the mating sidewall of VOBV/mandrel (not shown). In the embodiment shown, section A-A defines a cross section of grooved actuator rod 25A. Gas would pass into the liquid residing within each mandrel section hollowed out core 67 via grooves 94. Also shown in dotted line format is an alternate design comprising top slant holes 96 which could be drilled from top surface 37 to just below side surface 39. Slant holes 96 could replace the aforementioned grooves 94. Equivalent designs could include a metal burr acting to keep one rod slightly open in the closed position.

FIG. 9A is a side cross-sectional view of split orifice actuator rod 25B comprising central orifice 74, and four connected orifices 76 positioned about 45° from each other. Gas enters at gas entry aperture 86 located at actuator rod bottom surface 34. The gas moves up through central orifice 74, then through nozzle orifices 76, and exits into the liquid load from apertures 78 located along actuator rod top surface 37.

FIG. 9B is a side cross-sectional view of center orifice actuator rod 25C comprising central through orifice 84. Gas enters aperture 86 along actuator rod bottom surface 34 and gas exits aperture 88 at actuator rod top surface 37.

Figures 10, 10A, 10B:
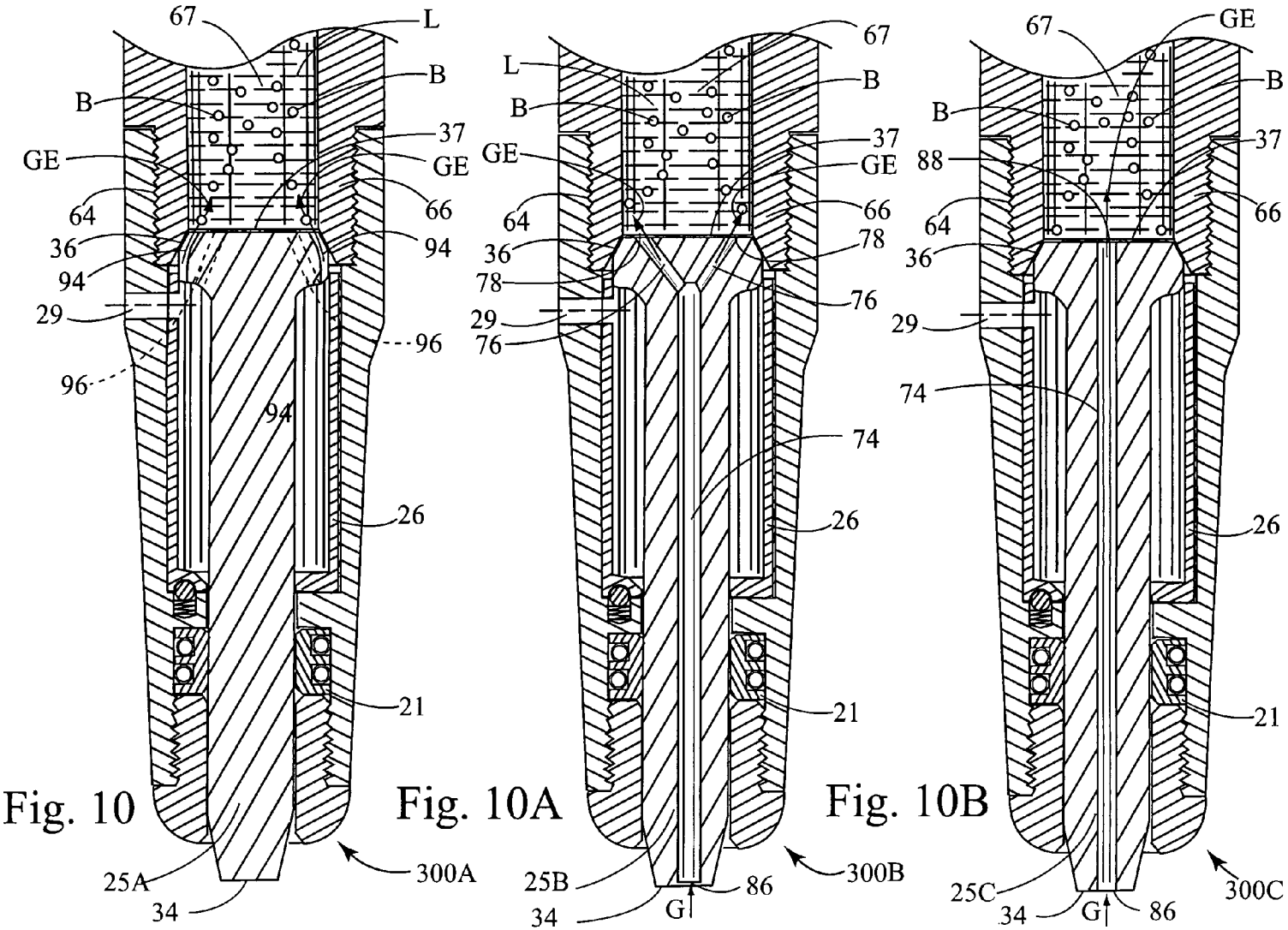
FIGS. 10, 10A, 10B are side cross-sectional views of the embodiments shown in FIGS. 9C, 9A and 9B respectively.

FIGS. 10, 10A, 10B are side cross-sectional views of the embodiments shown in FIGS. 9C, 9A and 9B, respectively. Each design is shown by way of example and not limitation. In each case a limited amount of gas is allowed to exit the seal area of the VOBV when the actuator is in a closed position and when the down hole pressure allows gas to be jetted through the valve.

FIG. 10 shows VOVB assembly 300A in a closed position. When down hole pressure is released, gas enters variable orifice opening 31 and/or access hole 29 (see FIG. 8A) and jets through grooves 94, transferring gas in direction GE to liquid load L. Also shown are the top slant holes 96 which could be drilled from top surface 37 to below the side surface. Slant holes 96 could replace grooves 94.

FIG. 10A is a side cross-sectional view showing split orifice actuator rod 25B in a closed position within VOBV assembly 300B. Split orifice actuator rod 25B is modified to comprise central orifice 74 and four connected orifices 76 positioned about 45° from each other. Gas G enters at gas entry aperture 86 located at actuator rod bottom surface 34. The gas moves up through central orifice 74, through nozzle orifices 76, and exits in direction GE into the liquid load L from apertures 78 located along actuator rod top surface 37.

FIG. 10B is a side cross-sectional view showing center orifice actuator rod 25B in a closed position within VOBV assembly 300C. Center orifice actuator rod 25B comprises central through orifice 84. Gas G enters aperture 86 along actuator rod bottom surface 34 and exits out gas exit aperture 88 in direction GE and into the liquid load L.

An actuator rod or side escape of the actuator rod or seal area has at least one exit orifice with a total cross sectional area in the range of about 0.25% to about 10% of the maximum plunger cross sectional area. Typically, the smallest range of the cross sectional area of the apertures (or escape area), which exit gas into hollowed out core 67, is about 3.22 $mm^2$ (about 0.005 $inch^2$) to about 32.3 $mm^2$ (about 0.05 $inch^2$). As an example, and not a limitation, in FIG. 10A the four nozzle orifices are each typically about 2.36 mm (about 0.093 inch) in diameter, combining to about 17.4 $mm^2$ (about 0.027 $inch^2$) of area as compared to the outside diameter of a typical plunger of about 47 mm (about 1.85 inch) or about 1735 $mm^2$ (about 2.69 $inch^2$).

Examples shown above in FIGS. 9, 9A, 9B, 10, 10A and 10B are shown by way of example and not limitation for variable type bypass valve embodiments. Modifications to fixed bypass valves, although not specifically shown, can also provide for the gas jetting in a similar manner as described above.

The liquid turbulence and aeration caused by the energy transfer allows for improved efficiency and productivity in wells that have high levels of liquid. The gas jetting allows for a more efficient lift of large liquid loads by increasing the plunger lift capacity of a liquid load and/or increasing the lift velocity of a given load. The liquid aeration plunger is easy to manufacture, and can easily be incorporated into the design of existing plunger geometries. As previously described, applying a soapy mixture down to the well bottom between the well casing and tubing can assist the aeration process by allowing a higher surface tension in the gaseous bubbles formed within the liquid load.

It should be noted that although the hardware aspects of the of the present invention have been described with reference to the depicted embodiment above, other alternate embodiments of the present invention could be easily employed by one skilled in the art to accomplish the gas momentum aspect of the present invention. For example, it will be understood that additions, deletions, and changes may be made to the orifices, apertures, or other interfaces of the plunger with respect to design other than those described herein.

Although the present invention has been described with reference to the depicted embodiments, numerous modifications and variations can be made and still the result will come within the scope of the invention. No limitation with respect to the specific embodiments disclosed herein is intended or should be inferred.

I claim:

1. A plunger comprising:

a cylindrical body having a top end, a lower end, and an internal longitudinal orifice;

said top end having one or more exit holes in fluid communication with said longitudinal orifice, said exit holes extending upwardly from said top end; and each of said exit holes comprising a diameter smaller than that of said longitudinal orifice, wherein a flow of gas from a well bottom passing through said exit holes can form a jet to aerate a liquid column above the plunger as the plunger rises.

2. The plunger of claim 1, wherein the top end further comprises a fish neck design.

3. The plunger of claim 1, wherein said cylindrical body comprises one or more removable sections.

4. The plunger of claim 1, wherein said top end comprises at least four apertures.

5. The plunger of claim 1, wherein the lower end further comprises an actuator rod bypass valve positionable in an open and a closed bypass mode, said actuator rod bypass valve further comprising one or more apertures to permit a pressurized gas to pass through to said internal longitudinal orifice when said actuator rod bypass valve is in the closed bypass mode during a plunger rise.

6. The plunger of claim 5, wherein the actuator rod bypass valve further comprises a grooved top surface.

7. The plunger of claim 1, wherein the lower end further comprises an actuator rod bypass valve with a hole through a portion thereof.

8. The plunger of claim 1, wherein said lower end comprises one aperture.

9. The plunger of claim 6, wherein the grooves of the top surface further comprise channels to permit a pressurized gas to pass through to said internal longitudinal orifice when said actuator rod bypass valve is in the closed bypass mode during a plunger rise.

10. A plunger comprising:

a mandrel having a top end, a bottom end, and a hollow core in communication with at least one orifice in said bottom end;

said top end connectable to a member comprising one or more exit apertures, said one or more exit apertures extending upwardly from said connectable member;

said hollow core capable of allowing a stream of gas from a well bottom to pass through to said one or more exit apertures; and wherein one or more of said exit apertures form a nozzle to force a gas into a liquid column above the plunger as the plunger rises.

11. The plunger of claim 10, wherein said bottom end further comprises a connectable member having one or more apertures in communication with said hollow core.

12. A bypass plunger comprising:

a mandrel portion having an internal longitudinal conduit in communication with at least one exit orifice in a top end of the plunger;

a bypass valve assembly connected to a lower end of the mandrel portion;

wherein a falling of the plunger results in the plunger hitting a well stop, causing an actuator rod housed in the bypass valve assembly to position the bypass valve assembly in a closed mode;

said actuator rod having at least one internal orifice in communication with an exit aperture at a top end of said actuator rod and an entry aperture at a lower end of said actuator rod;

said exit aperture of said actuator rod in communication with said internal longitudinal conduit of said mandrel portion; and wherein said actuator rod allows a stream of gas to pass therethrough the bypass valve assembly while said bypass valve assembly is in the closed mode to aerate a liquid column carried to the surface by the plunger.

13. The plunger of claim 12 further comprising a fish neck design.

14. A bypass plunger comprising:

a mandrel portion having an internal longitudinal conduit in communication with at least one exit orifice in a top end of the plunger;

a bypass valve assembly connected to a lower end of the mandrel portion;

wherein a falling of the plunger results in the plunger hitting a well stop, causing an actuator rod housed within the bypass valve assembly to position the bypass valve assembly in a closed mode;

said actuator rod having a flow through orifice in communication with said internal longitudinal conduit of said mandrel portion; and wherein said actuator rod allows a stream of gas to pass therethrough the bypass valve assembly while said bypass valve assembly is in the closed mode to aerate a liquid column carried to the surface by the plunger.

15. The bypass plunger of claim 14, wherein a top portion of the actuator rod comprises a mandrel seat.

16. The bypass plunger of claim 14, wherein a top portion of the actuator rod comprises a peripheral groove.

17. A bypass plunger comprising:

a mandrel portion having an internal longitudinal conduit in communication with at least one exit orifice in a top end of the plunger;

a bypass valve assembly connected to a bottom end of the mandrel portion;

wherein a falling of the plunger results in the plunger hitting a well stop, causing an actuator rod housed in the bypass valve assembly to position the bypass valve assembly in a closed mode;

said actuator rod having a top end and a mandrel seat means, said seat means functioning to bound a flow through an orifice when the actuator rod is in the closed mode during a plunger rise and allow a stream of gas to pass through the orifice into the internal longitudinal conduit and out the at least one exit orifice to aerate a liquid column above the plunger.

18. A plunger comprising:

a cylindrical body having an upper end, a lower end, and an internal longitudinal orifice;

said lower end having one or more apertures to receive and deliver a flow of pressurized gas from a well bottom to said internal longitudinal orifice during a plunger rise;

wherein said flow of pressurized gas exits said internal longitudinal orifice from one or more apertures positioned at said upper end to aerate a liquid carried to the surface by the plunger; and wherein the lower end further comprises an actuator rod bypass valve positionable in an open and a closed bypass mode, said actuator rod bypass valve further comprising one or more apertures to permit a pressurized gas to pass through to said internal longitudinal orifice when said actuator rod bypass valve is in the closed bypass mode during a plunger rise.

19. The plunger of claim 18, wherein the actuator rod bypass valve further comprises a grooved top surface.

20. The plunger of claim 19, wherein the grooves of the top surface further comprise channels to permit a pressurized gas to pass through to said internal longitudinal orifice when said actuator rod bypass valve is in the closed bypass mode during a plunger rise.

21. A plunger comprising:

a cylindrical body having an upper end, a lower end, and an internal longitudinal orifice;

said lower end having one or more apertures to receive and deliver a flow of pressurized gas from a well bottom to said internal longitudinal orifice during a plunger rise;

wherein said flow of pressurized gas exits said internal longitudinal orifice from one or more apertures positioned at said upper end to aerate a liquid carried to the surface by the plunger; and wherein the lower end further comprises an actuator rod bypass valve with a hole through a portion thereof.

* * * * *